US010861387B2

(12) United States Patent
Kim et al.

(10) Patent No.: US 10,861,387 B2
(45) Date of Patent: Dec. 8, 2020

(54) ELECTRONIC DEVICE AND OPERATION CONTROL METHOD OF ELECTRONIC DEVICE

(71) Applicant: Samsung Electronics Co., Ltd., Gyeonggi-do (KR)

(72) Inventors: Jung-Hyun Kim, Gyeonggi-do (KR); Seung-Jae Lee, Gyeonggi-do (KR); Young-Do Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/320,568

(22) PCT Filed: Jul. 26, 2017

(86) PCT No.: PCT/KR2017/008058
§ 371 (c)(1),
(2) Date: Jan. 25, 2019

(87) PCT Pub. No.: WO2018/021830
PCT Pub. Date: Feb. 1, 2018

(65) Prior Publication Data

US 2019/0156746 A1 May 23, 2019

(30) Foreign Application Priority Data

Jul. 28, 2016 (KR) ..... 10-2016-0096487

(51) Int. Cl.
*G09G 3/32* (2016.01)
*G09G 3/3233* (2016.01)
(Continued)

(52) U.S. Cl.
CPC ..... *G09G 3/3233* (2013.01); *G09G 3/2003* (2013.01); *G09G 3/3208* (2013.01);
(Continued)

(58) Field of Classification Search
None
See application file for complete search history.

(56) References Cited

U.S. PATENT DOCUMENTS

2005/0093850 A1 5/2005 Mori et al.
2008/0284767 A1 11/2008 Mori et al.
(Continued)

FOREIGN PATENT DOCUMENTS

KR 10-0799886 B1 1/2008
KR 10-2010-0016387 A 2/2010
(Continued)

*Primary Examiner* — Joseph R Haley
(74) *Attorney, Agent, or Firm* — Cha & Reiter, LLC.

(57) ABSTRACT

Various embodiments of the present invention relate to an electronic device and an operation control method of the electronic device, and the electronic device comprises an organic light-emitting diode (OLED) display panel including a plurality of sub pixels, a memory, and a processor, wherein the processor can be configured so as to confirm accumulated image data for each sub pixel of the display panel while a plurality of frames are displayed on the panel, generate a compensation image for compensating for a residual image generated on the display panel on the basis of the accumulated image data of each sub pixel when an event for residual image compensation occurs, and display the generated compensation image on the display panel.

12 Claims, 14 Drawing Sheets

(51) Int. Cl.
*G09G 3/3208* (2016.01)
*G09G 3/20* (2006.01)

(52) U.S. Cl.
CPC ..... *G09G 2300/0452* (2013.01); *G09G 2320/0233* (2013.01); *G09G 2320/046* (2013.01); *G09G 2320/048* (2013.01)

(56) References Cited

U.S. PATENT DOCUMENTS

| | | | | |
|---|---|---|---|---|
| 2014/0067202 | A1 | 3/2014 | Odland et al. | |
| 2015/0097876 | A1 | 4/2015 | Park et al. | |
| 2016/0335965 | A1* | 11/2016 | Huang ..... | G09G 3/3208 |
| 2017/0345377 | A1* | 11/2017 | Oh ..... | G09G 3/3208 |

FOREIGN PATENT DOCUMENTS

| | | | |
|---|---|---|---|
| KR | 10-2015-0021370 | A | 3/2015 |
| KR | 10-2015-0039969 | A | 4/2015 |
| KR | 10-2015-0075605 | A | 7/2015 |
| KR | 10-2016-0057229 | A | 5/2016 |
| KR | 10-2016-0059838 | A | 5/2016 |

* cited by examiner

ELECTRONIC DEVICE AND OPERATION CONTROL METHOD OF ELECTRONIC DEVICE

CROSS-REFERENCE TO RELATED APPLICATION(S)

This application is a National Phase Entry of PCT International Application No. PCT/KR2017/008058, which was filed on Jul. 26, 2017 and claims priority under 35 U.S.C. § 119 of Korean Patent Application No. 10-2016-0096487, filed on Jul. 28, 2016, in the Korean Intellectual Property Office the disclosure of which is incorporated herein by reference in its entirety.

TECHNICAL FIELD

The present disclosure relates to an electronic device including a display and an operation control method of the electronic device.

BACKGROUND ART

A display of an electronic device may be implemented in various types, and on the basis of flat panel display technology, can be categorized into a non-emissive type, which operates only when an external light source exists, and an emissive type, which itself emits light.

In general, a non-emissive display is a Thin Film Transistor-Liquid Crystal Display (TFT-LCD), and an emissive display is a Light-Emitting Diode (LED) display. Recently, as a display of an electronic device, use is made of Organic Light-Emitting Diode (OLED) displays using a self-light emitting phenomenon in which three red, green, and blue fluorescent organic compounds having self-light emitting characteristics are used to cause electrons and holes injected through a cathode and an anode to combine with each other in the compounds, thereby emitting light.

DETAILED DESCRIPTION OF THE INVENTION

Technical Problem

An OLED display includes red (R), green (G), and blue (B) color pixels, and a combination of three red, green, and blue color pixels may become one pixel. Also, in pixels, only an area in which an image is displayed is lit, and thus, color pixels or pixels are lit at different time intervals. Since an OLED is an organic light-emitting body, while the OLED is turned on, the lifespan thereof is reduced and thus the brightness thereof is reduced. That is, respective pixels initially maintain the same brightness, but different brightnesses are represented for each pixel or color pixel (sub-pixel) over time. When such pixels having different brightnesses gather together to form a group, a problem may arise in that the pixels show a color different from that of the background, and thus cause a viewer to see and recognize the pixels as a residual image.

In order to overcome the above-mentioned problems, there is an algorithm named "stress profiler" for finding a group of pixels that have different brightnesses and for forcibly degrading the group so that it has the same brightness as that of its surroundings, thereby removing the residual image. However, the algorithm needs continuous compensation work and thus consumes a lot of power and causes a system to unnecessarily use resources, thereby increasing the inefficiency of the software Accordingly, an aspect of present disclosure is to provide an electronic device and a control method of the electronic device which can overcome a residual image occurring while an image is displayed on an OLED display panel.

Technical Solution

In order to solve the above-mentioned problems or another problem, in accordance with an aspect of the present disclosure, an electronic device is provided. The electronic device may include an Organic Light-Emitting Diode (OLED) display panel including a plurality of sub-pixels, a memory, and a processor, wherein the processor is configured to identify sub-pixel-specific cumulative image data of the OLED display panel while a plurality of frames are displayed on the OLED display panel, when an event for compensating for a residual image occurs, generate a compensation image for compensating for a residual image occurring on the OLED display panel on the basis of the sub-pixel-specific cumulative image data, and display the generated compensation image on the OLED display panel.

In accordance with another aspect of the present disclosure, an operation control method of an electronic device is provided. The operation control method may include identifying sub-pixel-specific cumulative image data of an OLED display panel while a plurality of frames are displayed on the OLED display panel, when an event for compensating for a residual image occurs, generating a compensation image for compensating for a residual image occurring on the OLED display panel on the basis of the sub-pixel-specific cumulative image data, and displaying the generated compensation image on the OLED display panel.

Advantageous Effects

An electronic device and an operation control method of the electronic device, according to various embodiments, can generate a compensation image on the basis of sub-pixel-specific cumulative image data of a display panel and compensate for a residual image by using the generated compensation image while a plurality of frames are displayed on the display panel, and can reduce a residual image compensation time.

MODE FOR CARRYING OUT THE INVENTION

Figure 1:
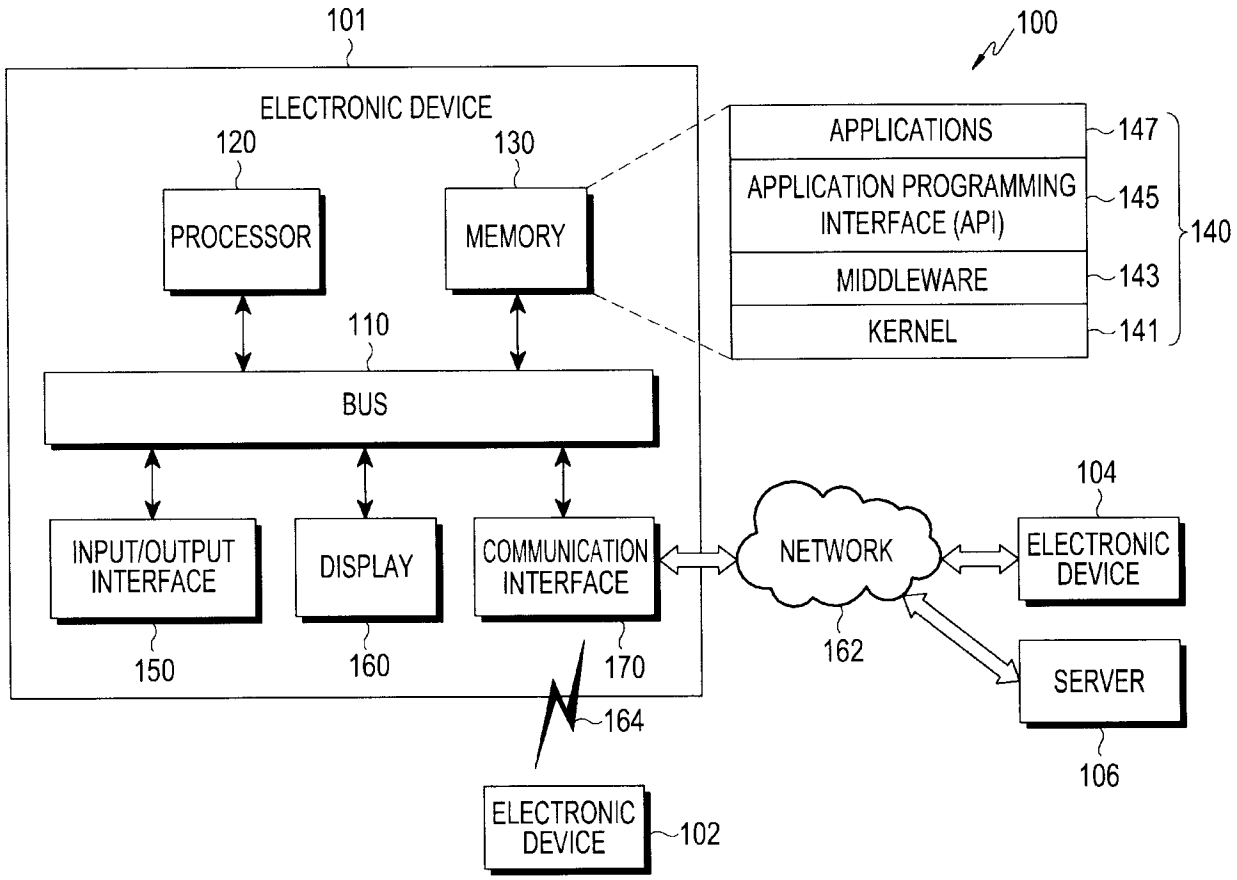
FIG. 1 is a diagram illustrating a network environment according to various embodiments of the present disclosure.

Hereinafter, various embodiments of the present disclosure will be described with reference to the accompanying drawings. The embodiments and the terms used therein are not intended to limit the technology disclosed herein to specific forms, and should be understood to include various modifications, equivalents, and/or alternatives to the corresponding embodiments. In describing the drawings, similar reference numerals may be used to designate similar constituent elements. A singular expression may include a plural expression unless they are definitely different in a context. As used herein, singular forms may include plural forms as well unless the context clearly indicates otherwise. The expression "a first", "a second", "the first", or "the second" used in various embodiments of the present disclosure may modify various components regardless of the order and/or the importance but does not limit the corresponding components. When an element (e.g., first element) is referred to as being "(functionally or communicatively) connected," or "directly coupled" to another element (second element), the element may be connected directly to the another element or connected to the another element through yet another element (e.g., third element).

The expression "configured to" as used in various embodiments of the present disclosure may be interchangeably used with, for example, "suitable for", "having the capacity to", "designed to", "adapted to", "made to", or "capable of" in terms of hardware or software, according to circumstances. Alternatively, in some situations, the expression "device configured to" may mean that the device, together with other devices or components, "is able to". For example, the phrase "processor adapted (or configured) to perform A, B, and C" may mean a dedicated processor (e.g., embedded processor) only for performing the corresponding operations or a generic-purpose processor (e.g., Central Processing Unit (CPU) or Application Processor (AP)) that can perform the corresponding operations by executing one or more software programs stored in a memory device.

An electronic device according to various embodiments of the present disclosure may include at least one of, for example, a smart phone, a tablet Personal Computer (PC), a mobile phone, a video phone, an electronic book reader (e-book reader), a desktop PC, a laptop PC, a netbook computer, a workstation, a server, a Personal Digital Assistant (PDA), a Portable Multimedia Player (PMP), a MPEG-1 audio layer-3 (MP3) player, a mobile medical device, a camera, and a wearable device. According to various embodiments, the wearable device may include at least one of an accessory type (e.g., a watch, a ring, a bracelet, an anklet, a necklace, a glasses, a contact lens, or a Head-Mounted Device (HMD)), a fabric or clothing integrated type (e.g., an electronic clothing), a body-mounted type (e.g., a skin pad, or tattoo), and a bio-implantable type (e.g., an implantable circuit). In some embodiments, the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™, a game console (e.g., Xbox™ and PlayStation™), an electronic dictionary, an electronic key, a camcorder, and an electronic photo frame.

In other embodiments, the electronic device may include at least one of various medical devices (e.g., various portable medical measuring devices (a blood glucose monitoring device, a heart rate monitoring device, a blood pressure measuring device, a body temperature measuring device, etc.), a Magnetic Resonance Angiography (MRA), a Magnetic Resonance Imaging (MRI), a Computed Tomography (CT) machine, and an ultrasonic machine), a navigation device, a Global Positioning System (GPS) receiver, an Event Data Recorder (EDR), a Flight Data Recorder (FDR), a Vehicle Infotainment Devices, an electronic devices for a ship (e.g., a navigation device for a ship, and a gyrocompass), avionics, security devices, an automotive head unit, a robot for home or industry, an Automatic Teller's Machine (ATM) in banks, Point Of Sales (POS) in a shop, or internet device of things (e.g., a light bulb, various sensors, electric or gas meter, a sprinkler device, a fire alarm, a thermostat, a streetlamp, a toaster, a sporting goods, a hot water tank, a heater, a boiler, etc.). According to some embodiments, an electronic device may include at least one of a part of furniture or a building/structure, an electronic board, an electronic signature receiving device, a projector, and various types of measuring instruments (e.g., a water meter, an electric meter, a gas meter, a radio wave meter, and the like). In various embodiments, the electronic device may be flexible, or may be a combination of one or more of the aforementioned various devices. The electronic device according to embodiments of the present disclosure is not limited to the above-described devices. In the present disclosure, the term "user" may indicate a person using an electronic device or a device (e.g., an artificial intelligence electronic device) using an electronic device.

An electronic device 101 within a network environment 100 according to various embodiments will be described with reference to FIG. 1. The electronic device 101 may include a bus 110, a processor 120, a memory 130, an input/output interface 150, a display 160, and a communication interface 170. In some embodiments, at least one of the elements of the electronic device 100 may be omitted therefrom, or the electronic device 100 may further include other elements. The bus 110 may include a circuit configured to interconnect the elements 110 to 170 and deliver communication (e.g., a control message or data) between the elements. The processor 120 may include one or more of a Central Processing Unit (CPU), an Application Processor (AP), and a Communication Processor (CP). The processor 120, for example, may be configured to execute operations or data processing related to the control and/or communication of at least one other element of the electronic device 101.

The memory 130 may include a volatile and/or non-volatile memory. The memory 130 may be configured to store, for example, instructions or data related to at least one other element of the electronic device 101. According to an embodiment, the memory 130 may store software and/or a program 140. The program 140 may include, for example, a kernel 141, middleware 143, an Application Programming Interface (API) 145, and/or application programs (or "applications") 147. At least some of the kernel 141, the middleware 143, and the API 145 may be referred to as an "Operating System (OS)". The kernel 141 may control or manage, for example, system resources (e.g., the bus 110, the processor 120, and the memory 130) used to execute operations or functions implemented by other programs (e.g., the middleware 143, the API 145, and the application programs 147). Also, the kernel 141 may provide an interface through which the middleware 143, the API 145, or the application programs 147 may access the individual elements of the electronic device 101 so as to control or manage the system resources.

The middleware 143 may serve as, for example, an intermediary that enables the API 145 or the application programs 147 to communicate with the kernel 141 to exchange data. Also, the middleware 143 may process one or more task requests received from the application programs 147 according to the priorities of the task requests. For example, the middleware 143 may assign priorities which allows use of the system resources (e.g., the bus 110, the processor 120, the memory 130, etc.) of the electronic device 101 to one or more of the application programs 147, and may process the one or more task requests. The API 145 is an interface through which the applications 147 control functions provided by the kernel 141 or the middleware 143, and may include, for example, at least one interface or function (e.g., instruction) for file control, window control, image processing, text control, and the like. The input/output interface 150, for example, may be configured to deliver, to the other element(s) of the electronic device 101, commands or data input from a user or a different external device. Alternatively, the input/output interface 150 may be configured to output, to the user or the different external device, commands or data received from the other element(s) of the electronic device 101.

Examples of the display 160 may include a Liquid Crystal Display (LCD), a Light-Emitting Diode (LED) display, an Organic Light-Emitting Diode (OLED) display, a MicroElectroMechanical Systems (MEMS) display, and an electronic paper display, or the like. The display 160 may display, for example, various types of content (e.g., text, images, videos, icons, symbols, etc.) to a user. The display 160 may include a touch screen, and may receive, for example, a touch, gesture, proximity, or hovering input using an electronic pen or a part of a user's body. The communication interface 170 may be configured to establish, for example, communication between the electronic device 101 and an external device (e.g., a first external electronic device 102, a second external electronic device 104, or a server 106). For example, the communication interface 170 may be configured to be connected to a network 162 through wireless or wired communication so as to communicate with the external device (e.g., the second external electronic device 104 or the server 106).

The wireless communication may use, for example, at least one of Long-Term Evolution (LTE), LTE-Advance (LTE-A), Code Division Multiple Access (CDMA), Wideband CDMA (WCDMA), Universal Mobile Telecommunications System (UMTS), Wireless Broadband (WiBro), Global System for Mobile communications (GSM), and the like, as a cellular communication protocol. According to an embodiment, the wireless communication may include, for example, at least one of Wi-Fi, Bluetooth, Bluetooth Low Energy (BLE), Zigbee, Near Field Communication (NFC), magnetic secure transmission, Radio Frequency (RF), and Body Area Network (BAN). According to an embodiment, the wireless communication may include Global Navigation Satellite System (GNSS). The GNSS may include, for example, at least one of a Global Positioning System (GPS), a Global Navigation Satellite System (Glonass), a Beidou Navigation Satellite System (hereinafter, "Beidou"), and a European Global Satellite-based Navigation System (Galileo). Hereinafter, the "GPS" may be interchangeably used herein with the "GNSS". The wired communication may include, for example, at least one of a Universal Serial Bus (USB), a High Definition Multimedia Interface (HDMI), Recommended Standard 232 (RS-232), power line communication, a Plain Old Telephone Service (POTS), and the like. The network 162 may include at least one of a telecommunication network such as a computer network (e.g., a LAN or a WAN), the Internet, and a telephone network.

Each of the first and second external electronic devices 102 and 104 may be of a type identical to, or different from, that of the electronic device 101. According to various embodiments, all or some of the operations executed in the electronic device 101 may be executed in another electronic device or multiple electronic devices (e.g., the electronic devices 102 and 104 or the server 106). According to an embodiment, when the electronic device 101 has to perform some functions or services automatically or in response to a request, the electronic device 101 may request another device (e.g., the electronic device 102 or 104 or the server 106) to execute at least some functions relating thereto, instead of, or in addition to, executing the functions or services by itself. Said another electronic device (e.g., the electronic device 102 or 104 or the server 106) may execute the requested functions or the additional functions and may deliver an execution result to the electronic device 101. The electronic device 101 may process the received result as it is or additionally so as to provide the requested functions or services. To this end cloud computing, distributed computing, or client-server computing technology may be used.

Figure 2:
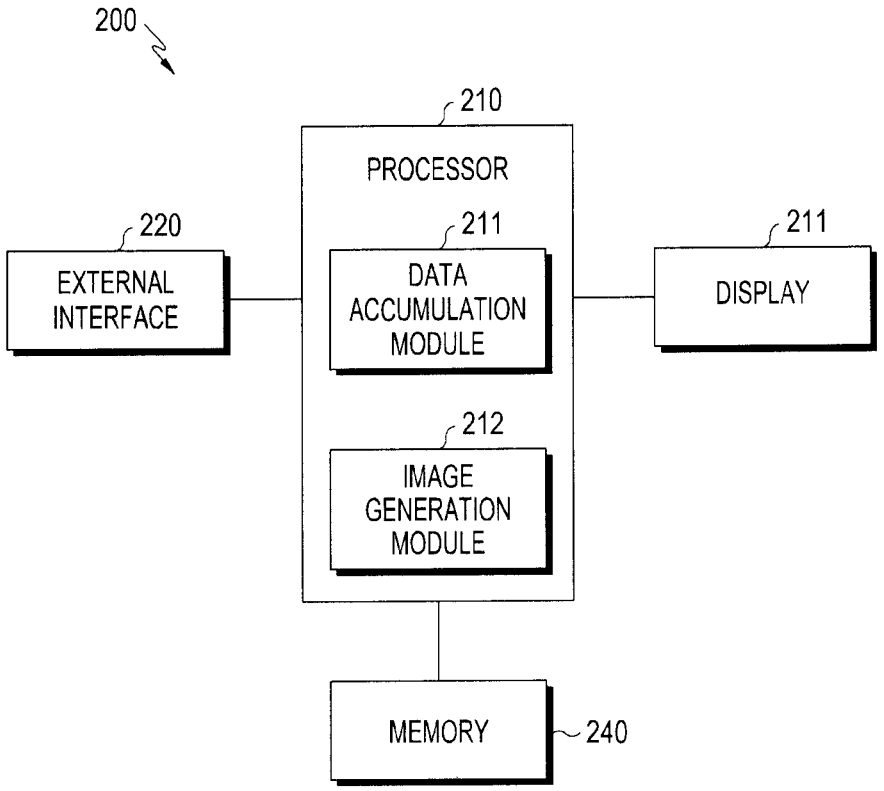
FIG. 2 is a diagram illustrating an example of a configuration of an electronic device according to various embodiments of the present disclosure.

FIG. 2 is a diagram illustrating an example of a configuration of an electronic device according to various embodiments of the present disclosure.

Referring to FIG. 2, according to various embodiments of the present disclosure, the electronic device (e.g., which is identical or similar to the electronic device 101 of FIG. 1) 200 may include a processor 210, an external interface 220, a display 230, and a memory 240. Also, the electronic device 200 may further include a communication module (not illustrated).

According to various embodiments of the present disclosure, the processor 210 (e.g., which is identical or similar to the processor 120 of FIG. 1) may process information according to an operation of the electronic device 200, and information according to the execution of a program, an application, or a function.

According to various embodiments of the present disclosure, the processor 210 may control the display 230 to display an image or a moving image. The processor 210 may include a data accumulation module 211 and an image generation module 212 which are configured to compensate for a residual image generated while a plurality of frames of an image or a moving image are displayed on the display 230.

According to various embodiments of the present disclosure, while a plurality of frames of an image (e.g., a still image or a moving image) are displayed on the display 230, the processor 210 may use the data accumulation module 211 to identify image data of a frame (e.g., a still image) for each of sub-pixels (e.g., color pixels (R, G, and B pixels)) in all pixels of a display panel included in the display 230. The processor 210 may continuously accumulate image data checked for each sub-pixel in all the pixels. According to various embodiments, the processor 210 may include the checked image data in cumulative image data, and may store, in the memory, the cumulative image including the checked image data. The image data is information about each sub-pixel which is expressed by an organic light-emitting diode included in each sub-pixel of the display panel, and may signify information related to at least one of the gradation and the brightness (e.g., luminance) of a light source. According to various embodiments, the image data may include pixel values representing R, G, and B color information expressed by sub-pixels. The cumulative image data may include pieces of image data accumulated in a frame unit of an image being displayed. According to various embodiments, the cumulative image data is information related to the use frequency or use time of an organic light-emitting diode for each sub-pixel, and may include at least one of, for example, information on whether an organic light-emitting diode is lit, the count value of lighting, and the lighting maintenance time. The processor 210 may identify the sub-pixel-specific degradation degree, gradation, or luminance on the basis of pieces of image data included in stored sup-pixel-specific cumulative image data, and information related to the use frequency or use time of an organic light-emitting diode. According to various embodiments, the processor 210 may accumulate image data of an image continuously displayed until a compensation image for compensating for a residual image is displayed from a point in time at which the display panel is initially lit or after data is initialized.

The processor 210, by the image generation module 212, may generate a virtual residual image on the basis of the sub-pixel-specific cumulative image data when an event for compensating for a residual image occurs, may generate a compensation image by inverting the residual image; and control continuously display the generated compensation image on the display. In this configuration, examples of an event for compensating for a residual image may be classified into an active event and a passive event. An active event may signify that a user indicates compensating for a residual image for a set time according to identifying for the occurrence of a residual image in a displayed moving image or image, or may signify that the user indicates compensating for a residual image for a set time, when a luminance degradation level becomes lower than or equal to a predetermined threshold. The set time is a time for which an operation of compensating for a residual image is executed, and may be set at the time of manufacturing or by the user through a related application. For example, the set time may be configured as a time period during which the user does not use the display.

According to various embodiments, when the luminance degradation level becomes lower than or equal to a set value in a particular pixel area, the processor 210 may generate a residual-image compensation event, and may notify the user that it is necessary to compensate for a residual image.

In order to reduce additional loss of brightness, the processor 210 may configure a pixel including a sub-pixel having the largest cumulative value of cumulative image data in the compensation image, to be white (e.g., R, G, and B color pixels are all turned on or only a white pixel is turned on) and may configure a pixel including a sub-pixel having the smallest cumulative value of cumulative image data therein, to be black (e.g., R, G, and B color pixels are all turned off or a white pixel is turned off).

According to various embodiments of the present disclosure, the processor 210 may generate a virtual residual image on the basis of the sub-pixel-specific cumulative image data (e.g., sub-pixels are R, G, and B color pixels or R, G, B, and W color pixels). The processor 210 may generate an inverse image by inverting the residual image, may calculate a sub-pixel-specific compensation value, and may generate a compensation image by compensating for the inverse image on the basis of the calculated sub-pixel-specific compensation value.

According to various embodiments of the present disclosure, the processor 210 may identify a luminance degradation level on the basis of sub-pixel-specific cumulative image data of the display panel, and may generate a compensation image on the basis of information indicating the luminance degradation level. The processor 210 may calculate the light emission amount per hour of each sub-pixel on the basis of the cumulative image data, and may identify the value corresponding to the calculated light emission amount in a configured Look-Up Table (LUT), so as to identify the luminance degradation level by an organic light-emitting diode for each sub-pixel.

According to various embodiments, when the event occurs and a compensation image is displayed, the processor 210 may initialize sub-pixel-specific cumulative data.

According to various embodiments, when a fixed image or moving image (e.g., a screen saver or a moving image repeatedly reproduced for a predetermined period of time) is displayed on the display, the processor 210 may generate a virtual residual image generated on the basis of images of the fixed moving image without accumulating image data until a time point at which the event occurs, and may generate a compensation image by inverting the generated virtual residual image.

According to various embodiments, the processor 210 is a hardware module or a software module (e.g., an application program), and may be a hardware element (function) or a software element (program) including at least one of various sensors, a data measurement module, an input/output interface, a module configured to manage a state or environment of the electronic device, and a communication module, which are provided in the electronic device.

According to various embodiments of the present disclosure, the external interface (e.g., the input/output interface 150 of FIG. 1) 220 of the electronic device may be a user interface, and may include an input apparatus configured to be capable of receiving information from the user. The input apparatus may transmit, to the processor 210, various pieces of information among number and text information input from the user, various function settings, and a signal input in relation to function control of the electronic device. Also, the input apparatus may support a user input for executing a module or an application configured to support a particular function. The input apparatus may include at least one of a key input means such as a keyboard or a keypad, a touch input means such as a touch sensor or a touch pad, a sound source input means, a camera, and various sensors, and may also include a gesture input means. In addition, the input apparatus may include all types of input means which are currently being developed or will be developed in the future. Further, according to various embodiments of the present disclosure, the input apparatus may receive information input by the user through the touch panel on the display or the camera, and may transmit the input information to the processor 210. Further, according to various embodiments of the present disclosure, the input apparatus may receive an input signal, related to data to be transmitted to another electronic device, through the sound source input means (e.g., a microphone) from the user, and may transmit the input signal to the processor 210.

According to various embodiments of the present disclosure, the display (e.g., the display 160 of FIG. 1) 230 of the electronic device 200 may display an image (a still image or a moving image) under the control of the processor 210.

The display 230 according to various embodiments of the present disclosure may include a display panel including a plurality of organic light-emitting diodes. When a compensation image is generated by the processor 210, the display 230 may continuously display the generated compensation image so as to compensate for a residual image. Also, the display 230 may display information on an application related to an operation for overcoming a residual image, and may display information input from the input apparatus through the application. Further, when an event for compensating for a residual image has occurred, the display 230 may display information related to the event that has occurred.

In addition, according to various embodiments of the present disclosure, when the display 230 is implemented in a touch screen type, the input apparatus and/or the display 230 may correspond to a touch screen. When the display 230, together with the input apparatus, is implemented in the touch screen type, the display 230 may display various pieces of information generated in response to the user's touch action.

Further, according to various embodiments, the display 230 may include at least one of an OLED display, an Active Matrix OLED (AMOLED) display, a flexible display, and a three-dimensional display. Also, some displays among them may be implemented as a transparent type or a light-transmissive type so that the outside can be seen therethrough. The display may be implemented as a transparent display type including a Transparent OLED (TOLED).

According to various embodiments of the present disclosure, the memory 240 (e.g., the memory 130 in FIG. 1) of the electronic device may temporarily store not only a program necessary for operating functions according to various embodiments, but also various data generated during execution of the program. The memory 240 may largely include a program area and a data area. The program area may store pieces of information related to driving the electronic device, such as an Operating System (OS) which boots the electronic device. The data area may store transmitted/received data or generated data according to various embodiments. Also, the memory 240 may include at least one storage medium among a flash memory, a hard disk, a multimedia card micro-type memory (e.g., a Secure Digital (SD) or Extreme Digital (XD) memory), a Random Access Memory (RAM), and a Read-Only Memory (ROM). According to various embodiments, the memory 240 may store an input image or a moving image, and may store an application related to a function of compensating for a residual image generated on the display panel.

Also, the memory 240 according to various embodiments of the present disclosure may accumulate sub-pixel-specific image data of an image displayed on the display 230, and may store the accumulated sub-pixel-specific image data as cumulative data. The memory 240 may continuously accumulate image data until a residual-image compensation event occurs.

As described above, in various embodiments of the present disclosure, the main elements of the electronic device have been described with reference to the electronic device of FIG. 2. However, in various embodiments of the present disclosure, not all of the elements illustrated in FIG. 2 are essential elements of the electronic device. The electronic device may be implemented by a larger number of elements than the elements of FIG. 2 or by a smaller number of elements than the elements of FIG. 2. Also, the positions of the main elements of the electronic device, described in detail with reference to FIG. 2, may be changed according to various embodiments.

Figure 3:
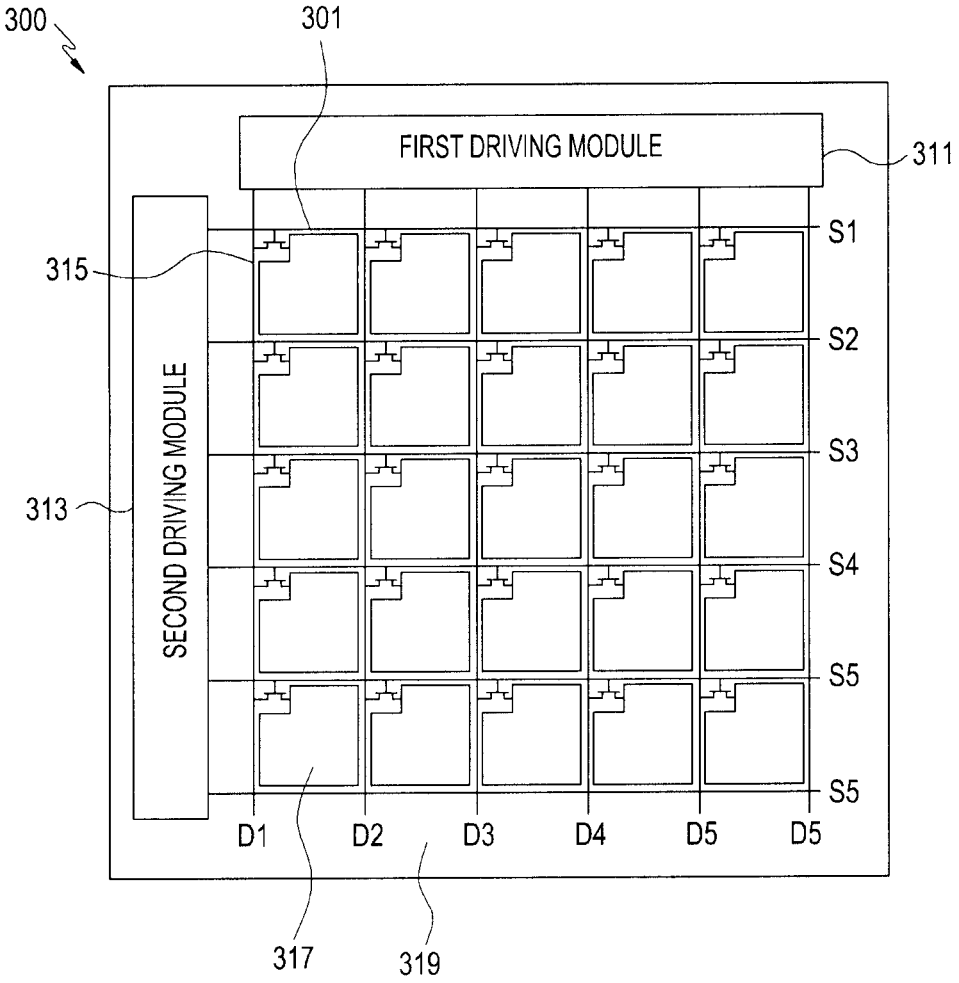
FIG. 3 is a diagram illustrating an example of a configuration of a display panel of an electronic device according to various embodiments of the present disclosure.

FIG. 3 is a diagram illustrating an example of a configuration of a display panel of an electronic device according to various embodiments of the present disclosure.

Referring to FIG. 3, a display of the electronic device, according to various embodiments of the present disclosure, may include, for example, the display panel 300 including a plurality of OLEDs. The display panel 300 may be driven by an active driving scheme, that is, a scheme in which each pixel is driven by one element. The display panel 300 may include, for each sub-pixel 301, a display Thin-Film Transistor (TFT) 315 configured to serve as a switch and a storage capacitor. In the present example, the storage capacitor may be configured to store a signal (voltage) input to one pixel and allow emission of a predetermined amount of light so that the signal can be maintained in one frame.

Also, the display panel 300 may include a data supply line configured to supply data to the TFT 315 of each pixel, and a signal supply line configured to supply a current signal thereto.

An electronic device, according to one of various embodiments of the present disclosure, may include: an OLED display panel including a plurality of sub-pixels; a memory; and a processor, wherein the processor is configured to identify sub-pixel-specific cumulative image data of the OLED display panel while a plurality of frames are displayed on the OLED display panel, when an event for compensating for a residual image occurs, generate a compensation image for compensating for a residual image occurring on the OLED display panel on the basis of the sub-pixel-specific cumulative image data, and display the generated compensation image on the OLED display panel.

According to various embodiments of the present disclosure, the processor may be configured to generate the compensation image by inverting a stored virtual image or a virtual residual image generated on the basis of the sub-pixel-specific cumulative image data.

According to various embodiments of the present disclosure, the processor may be configured to when the compensation image is generated, set, to be white, a pixel including a sub-pixel having the largest cumulative value of the sub-pixel-specific cumulative image data, and set, to be black, a pixel including a sub-pixel having the smallest cumulative value of the sub-pixel-specific cumulative image data.

According to various embodiments of the present disclosure, the processor may be configured to calculate a compensation value for each sub-pixel, and generate the compensation image by compensating for an inverse image, obtained by inverting the virtual residual image, on the basis of the calculated compensation value.

According to various embodiments of the present disclosure, the processor may be configured to identify luminance degradation on the basis of cumulative data accumulated for each pixel on the OLED display panel and generate the virtual residual image on the basis of a luminance degradation level.

According to various embodiments of the present disclosure, the processor may be configured to generate and display the compensation image at a time set by a user, when a request for compensating for a residual image is received as the event through an external interface from the user.

According to various embodiments of the present disclosure, the processor may be configured to initialize the sub-pixel-specific cumulative image data when the event occurs and the compensation image is displayed.

According to various embodiments of the present disclosure, the processor may be configured to convert the sub-pixel-specific cumulative image data into a light emission amount per hour of a sub-pixel and identify a sub-pixel-specific luminance degradation level by using the converted light emission amount and a configured look-up table (LUT).

According to various embodiments of the present disclosure, the processor may be configured to when the luminance degradation level becomes lower than or equal to a set value in a particular pixel area, generate a residual-image compensation event, and notify the user that it is necessary to compensate for a residual image.

According to various embodiments of the present disclosure, the processor may be configured to, when a fixed moving image is repeatedly displayed on the OLED display panel, generate the compensation image by inverting a virtual residual image generated on the basis of images of the fixed moving image without accumulating image data until a point in time at which the event occurs.

Figure 4:
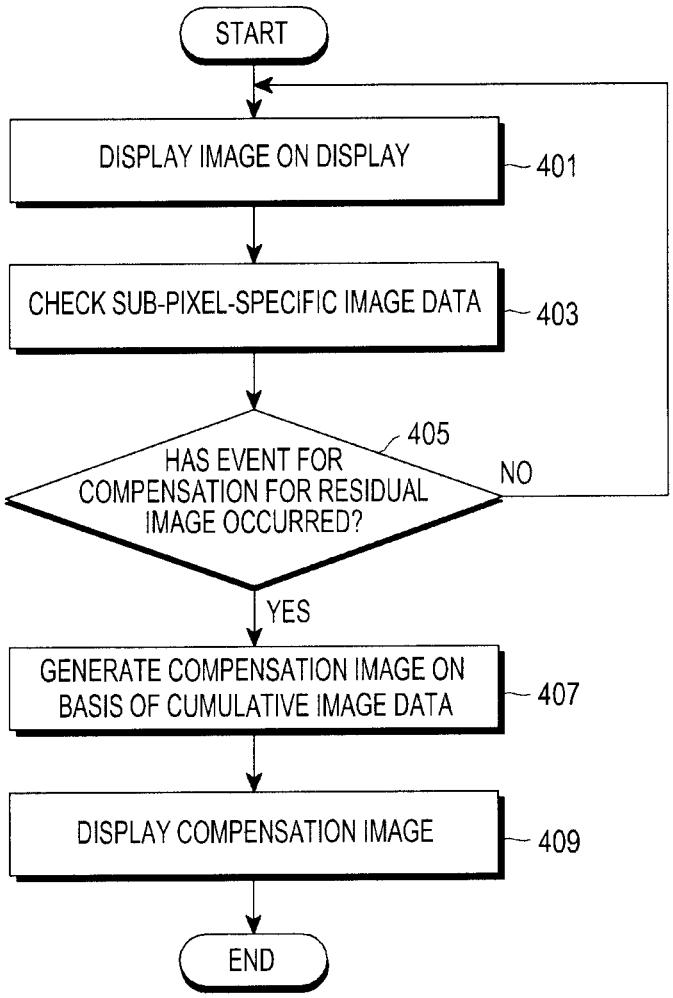
FIG. 4 is a view illustrating an operation of an electronic device according to various embodiments of the present disclosure.

FIG. 4 is a view illustrating an operation of an electronic device according to various embodiments of the present disclosure.

Referring to FIG. 4, in operation 401, the electronic device (e.g., the electronic device 101 of FIG. 1 or the electronic device 200 of FIG. 2) according to various embodiments of the present disclosure may display an image (e.g., a still image or a moving image) on the display panel.

In operation 403, while a plurality of frames of the image are displayed on the display, the electronic device may continuously accumulate image data (e.g., pixel values) of one frame, for each sub-pixel in all the pixels of the display panel. The electronic device 200 may include the accumulated image data in cumulative image data, and may store the cumulative image data including the accumulated image data in a relevant area of the memory.

While data is continuously displayed on the display panel, for example, if data is continuously displayed only in an area of particular pixels, cumulative image data of the particular pixels may be different from that of pixels corresponding to another area. Also, an area in which data is continuously displayed, that is, pixels in which OLEDs continuously emit light, has a large amount of cumulative image data, but an area in which an image is not continuously displayed, that is, sub-pixels in which OLEDs do not emit light or intermittently emit light, has a small amount of cumulative image data. As a result, a pixel area, in which cumulative image data has a large value, corresponds to pixels, the luminance of which is degraded, and pixels of an area, in which an image is not displayed, have high luminance. When a homogeneous image, for example, a solid white or solid gray screen is displayed, due to the occurrence of a luminance difference, an image such as a residual image may be visible due to the difference between a pixel having a low luminance and a pixel having a high luminance.

In operation 405, the electronic device may determine whether an event for compensating for a residual image has occurred. When it is determined that the event for compensating for a residual image has not occurred, in operations 401 and 403, the electronic device may continuously accumulate image data of the image being displayed. In contrast, when the event for compensating for a residual image has occurred, the electronic device may perform operation 407.

In operation 407, the electronic device may read sub-pixel-specific cumulative image data, and may generate a compensation image on the basis of the read sub-pixel-specific cumulative image data.

In operation 409, the electronic device may display the generated compensation image on the display panel. The electronic device may continuously display the compensation image during a set period of time in which a residual image can be overcome.

Also, according to various embodiments of the present disclosure, during or after operation 409 in the operation procedure of FIG. 4, the electronic device may initialize the sub-pixel-specific cumulative image data.

In operation 405 of FIG. 4 as described in detail above, according to various embodiments, when a request for compensating for a residual image is received from a user through an external interface, the electronic device may generate an event so that a compensation image can be generated at a time set by the user. At a time set to generate an event, a related application may be executed according to the user's request, and a set time for compensating for a residual image may be set through the executed related application. For example, the set time may be configured as a time period during which the user does not use the electronic device. Also, according to various embodiments of the present disclosure, when the luminance degradation level becomes less than or equal to a set value in a particular pixel area, the electronic device may generate an event for compensating for a residual image. In the present example, the electronic device may notify the user that it is necessary to compensate for a residual image.

Operation 407 of FIG. 4, that is, the operation of generating a compensation image, will be described in detail.

Figure 5:
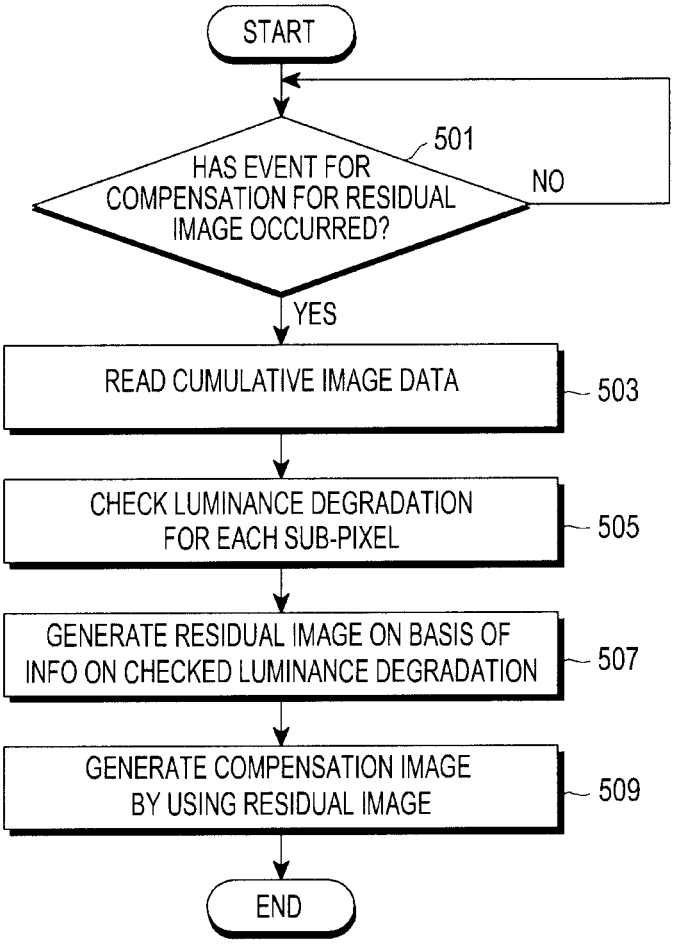
FIG. 5 is a view illustrating an operation of an electronic device according to various embodiments of the present disclosure.

FIG. 5 is a view illustrating an operation of an electronic device according to various embodiments of the present disclosure.

Referring to FIG. 5, according to various embodiments of the present disclosure, in operation 501, when an event for compensating for a residual image occurs, the electronic device may idnetify image data of a frame displayed on the display panel, and may store the checked image data in the memory so as to add the same to accumulated image data stored therein. The electronic device may continuously accumulate image data until the next event for compensating for a residual image occurs after the display panel is initially lit or the accumulated image data is initialized.

In operation 503, the electronic device may convert, into a brightness according to time, sub-pixel-specific cumulative image data (e.g., a final cumulative value of the use frequency (e.g., a lighting count value) of an OLED, or cumulative image data) of the display panel, may compare the converted brightness value with a pre-configured look-up table (LUT), and may calculate a total lighting time of OLEDs included in each pixel of the display panel, so as to identify a luminance degradation level of each pixel. A light emission luminance of an OLED may be continuously degraded as the OLED is lit for a long time. Accordingly, the larger the cumulative value of cumulative image data stored in the memory a pixel has, the smaller the amount of light actually emitted by the pixel may become. In the present example, the pre-configured look-up table (LUT) is a table including values obtained by quantifying lifespans of OLEDs, may be generated through an experiment on OLEDs or evaluation thereof during the manufacture thereof, and may indicate the luminance degradation level according to a total light emission amount on the basis of a total light emission time of an OLED and a final cumulative value of cumulative image data of each pixel.

In operation 505, the electronic device may generate a residual image on the basis of information on luminance degradation of each sub-pixel indicating the identified luminance degradation level of each sub-pixel.

In operation 507, the electronic device may generate an inverse image by inverting the residual image, and may generate a compensation image by applying a calculated compensation value to the generated inverse image.

According to various embodiments, when a displayed image (a still image or a moving image) is a repeatedly-displayed fixed image, which indicates that an image to be reproduced is previously known, the electronic device may generate, in advance, a residual image on the basis of the fixed image to be reproduced.

According to various embodiments, in order to overcome overall brightness degradation caused by unnecessary luminance degradation, the electronic device may generate a compensation image by applying a calculated compensation value to an inverse image obtained by inverting the generated residual image.

Figure 6A:
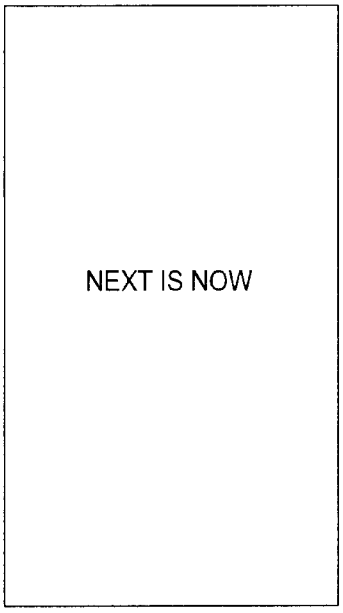
FIG. 6 is a view illustrating images displayed on a display panel according to various embodiments of the present disclosure.
Figure 6B:
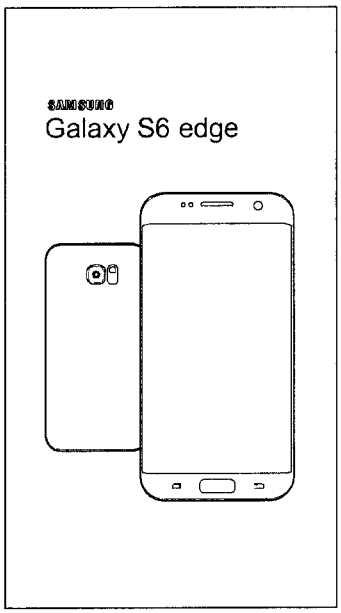
Figure 6C:
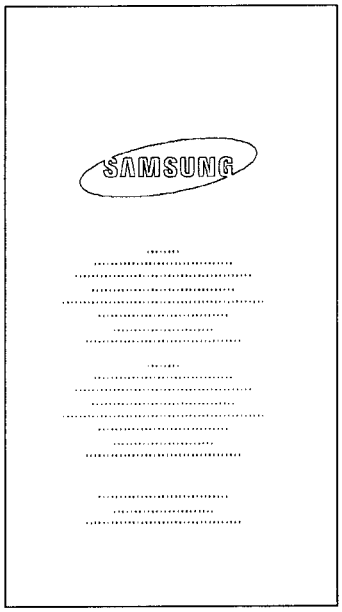
Figure 11:
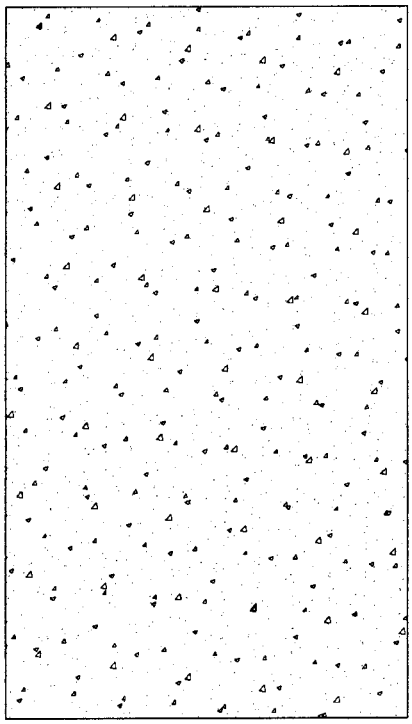
FIG. 11 is a view illustrating an example of a compensation image for overcoming a residual image according to various embodiments of the present disclosure.

FIG. 6 is a view illustrating images displayed on a display panel according to various embodiments of the present disclosure. FIGS. 7 to 10 are views each illustrating an example of a graph for overcoming a residual image of images displayed on a display panel of an electronic device according to various embodiments of the present disclosure. FIG. 11 is a view illustrating an example of a compensation image for overcoming a residual image according to various embodiments of the present disclosure.

Referring to FIG. 6, the electronic device may reproduce a moving image on the display panel. According to various embodiments, (a) to (c) of FIG. 6 may each show a plurality of frames or a still image of a moving image.

According to various embodiments, while reproducing a moving image of FIG. 6, the electronic device may identify and store image data accumulated for each sub-pixel of the display panel, and may identify the lighting history of a sub-pixel-specific OLED on the basis of the stored cumulative image data. Through the lighting history, the electronic device may identify a luminance degradation level caused by the sub-pixel-specific OLED.

Hereinafter, each of the five pixels shown in the graphs, which will be described with reference to FIGS. 7 to 10, may be described as a pixel including sub-pixels.

Figure 7:
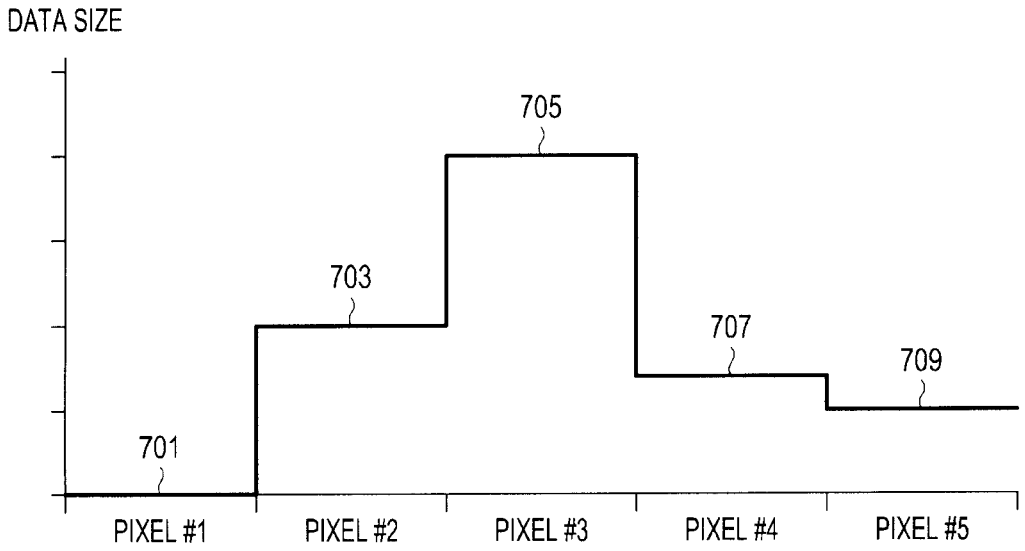
FIG. 7 is a view illustrating an example of a graph for overcoming a residual image of images displayed on a display panel of an electronic device according to various embodiments of the present disclosure.

As illustrated in FIG. 7, it is possible to check an image pattern of an image represented by, for example, five pixels 701, 703, 705, 707 and 709. Pixel #1 701 among the five pixels 701, 703, 705, 707 and 709 may represent black, pixel #3 705 may represent white, and pixels #2, #4, and #5 709 may represent intermediate gradation. In the present example, a larger cumulative value, which represents a cumulative amount of image data included in sub-pixel-specific cumulative image data, may signify a higher gradation. When an image represented by the five pixels 701, 703, 705, 707, and 709 is continuously displayed, the electronic device may identify that since the largest amount of data is represented by pixel #3 705, that is, a cumulative value of image data of pixel #3 705 is the largest, OLEDs included in pixel #3 705 are most frequently lit, and thus pixel #3 has the highest lighting history, and pixel #1 701 has no lighting history or has been lit by a frequency less than or equal to a set value. In the present example, pixel #1 701 may mainly represent black or a low gradation only.

Figure 8:
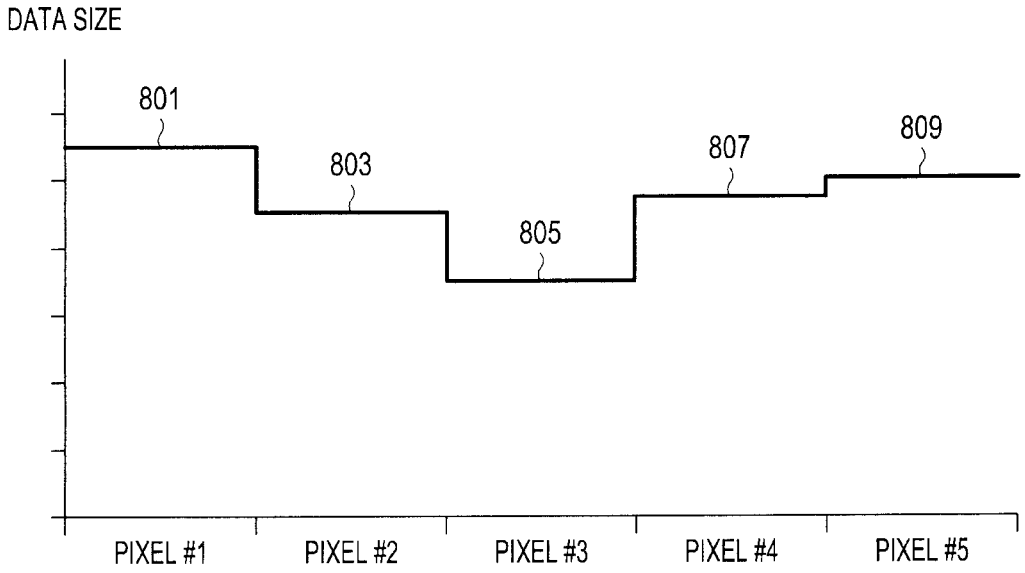
FIG. 8 is a view illustrating an example of a graph for overcoming a residual image of images displayed on a display panel of an electronic device according to various embodiments of the present disclosure.

When an image is continuously displayed, a residual image (e.g., the pattern of the residual image as illustrated in FIG. 8) is generated. Referring to FIG. 8, it can be identified that among five displayed pixels 801, 803, 805, 807, and 809, pixel #1 801 has a low lighting history and thus has the highest luminance; and pixel #3 801 has the highest lighting history and thus has the lowest luminance.

Figure 9:
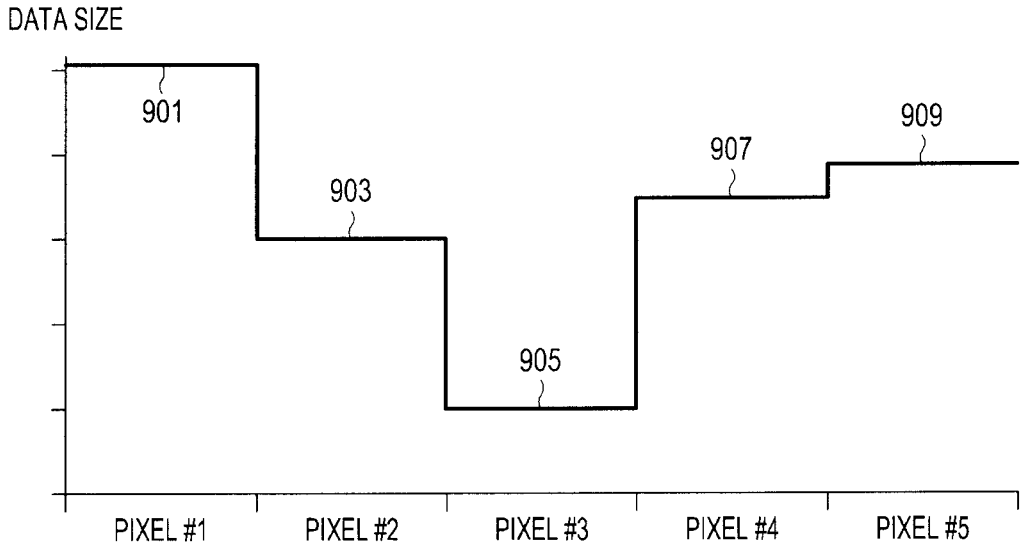
FIG. 9 is a view illustrating an example of a graph for overcoming a residual image of images displayed on a display panel of an electronic device according to various embodiments of the present disclosure.
Figure 10:
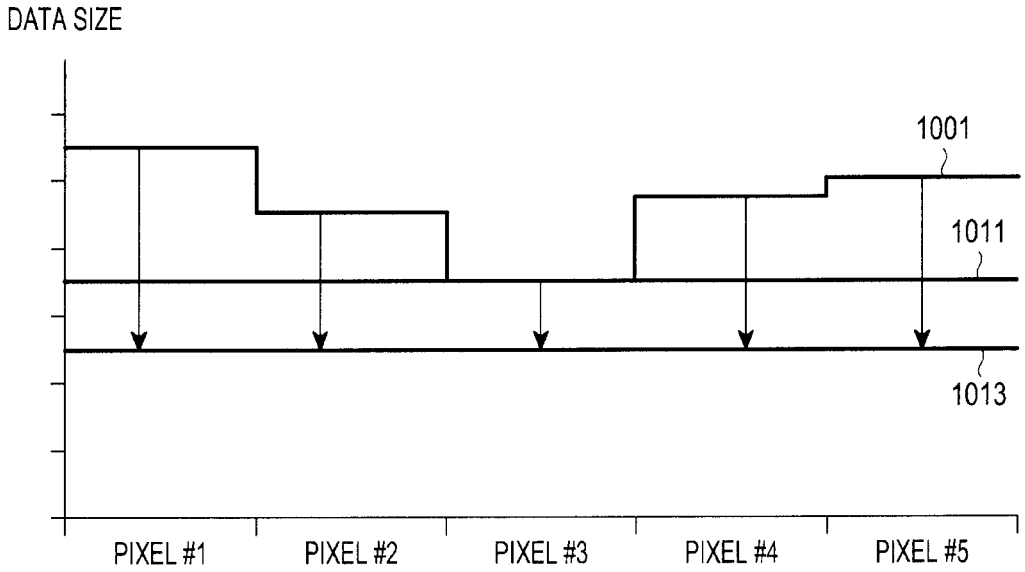
FIG. 10 is a view illustrating an example of a graph for overcoming a residual image of images displayed on a display panel of an electronic device according to various embodiments of the present disclosure.

In order to overcome the generated residual image, the electronic device may generate an inverse image, that is, a compensation image (e.g., the pattern of the compensation image as illustrated in FIG. 9), by inverting a virtual residual image (e.g., the pattern of the residual image as illustrated in FIG. 7).

Referring to FIG. 9, the electronic device may identify that among five pixels 901, 903, 905, 907, and 909, pixel #1 901 has the largest data size and pixel #3 905 has the smallest data size on the basis of a pattern of an inverse image. When such an inverse image, that is, a compensation image, is continuously displayed, it can be identified that OLEDs of each pixel are subjected to stress accumulated by the compensation image and thus the actually-generated residual image (e.g., a pattern 1001 indicating a residual image) converges to a pattern 1013 representing a second reference value of FIG. 10 from a pattern 1011 representing a first reference value of FIG. 10.

According to the scheme as illustrated in FIGS. 7 to 9, the electronic device may generate an inverse image by simply inverting the displayed image, and may generate, for example, a compensation image as illustrated in FIG. 11 by applying the generated inverse image. The electronic device continuously displays the compensation image generated in this manner on the display panel, and thus can overcome a residual image phenomenon caused while an image (e.g., the images of FIG. 6) is displayed on the display panel.

Figure 12:
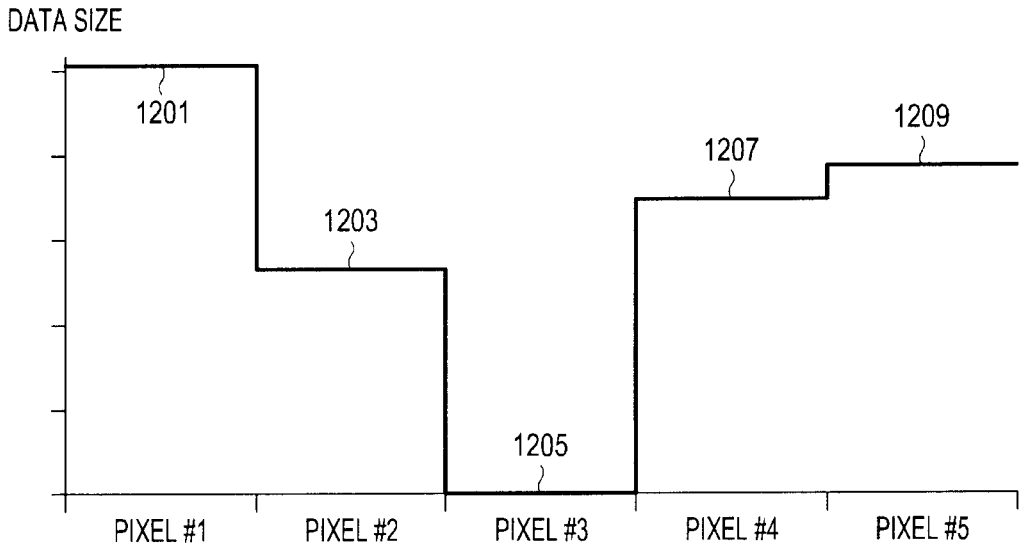
FIG. 12 is a view illustrating an example of a graph for overcoming a residual image of images displayed on a display panel of an electronic device according to various embodiments of the present disclosure.
Figure 13:
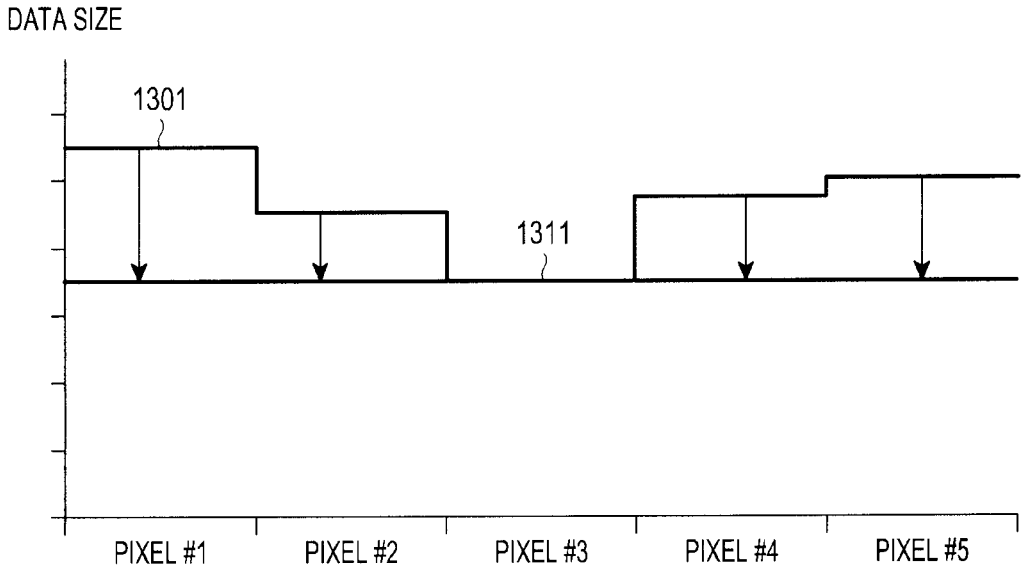
FIG. 13 is a view illustrating an example of a graph for overcoming a residual image of images displayed on a display panel of an electronic device according to various embodiments of the present disclosure.
Figure 14:
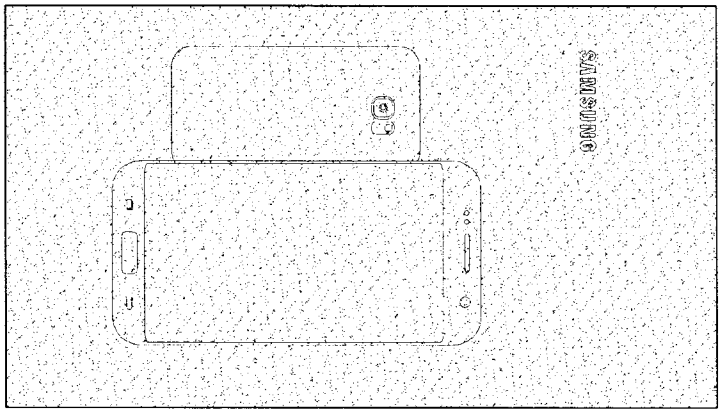
FIG. 14 is a view illustrating an example of a compensation image for overcoming a residual image according to various embodiments of the present disclosure.

FIGS. 12 and 13 are views each illustrating an example of a graph for overcoming a residual image of images displayed on a display panel of an electronic device according to various embodiments of the present disclosure. FIG. 14 is a view illustrating an example of a compensation image for overcoming a residual image according to various embodiments of the present disclosure.

Hereinafter, each of the five pixels shown in graphs, which will be described with reference to FIGS. 12 and 13, may be described as a pixel including sub-pixels.

Referring to FIG. 12, the electronic device can overcome additional loss of brightness by performing a normalization procedure for, among five pixels 1201, 1203, 1205, 1207, and 1209 in an inverse image obtained by inverting a displayed image, configuring pixel #1 1201 having the largest data size to be white and configuring pixel #3 1205 having the smallest data size to be black. Accordingly, the electronic device may adjust the data size of an inverse image as described with reference to FIG. 9 so as to generate a compensation image according to the pattern of a compensation image as illustrated in FIG. 12. As a result, as illustrated in FIG. 13, a pattern 1301 of an actually-generated residual image converges to a pattern 1311 representing a first reference value so as to enable compensation for a residual image, and thus it is possible to compensate for pixel #3 without additional luminance degradation.

According to various embodiments, as illustrated in FIG. 12, the electronic device may calculate a compensation value for adjusting the size of an inverse image for each sub-pixel (e.g., R, G, and B color pixels) by performing a normalization procedure.

$$f_{Red}(x) = 255 \times \left(\frac{Rn - \text{P_Min}}{\text{P_Max} - \text{P_Min}}\right)^{\frac{1}{2.2}} \quad \text{[Equation 1]}$$

Equation 1 is used to calculate a compensation value of a red (R) color pixel, and compensation values of the remaining green (G) and blue (B) color pixels may be calculated similarly. In Equation 1, Rn may signify each red (R) color pixel of a display panel, P_min may represent a minimum data cumulative value among all the color pixels, and P_max may represent a maximum data cumulative value thereamong. 2.2 represents the gamma power and is a value which is applied to allow for a gradation.

According to various embodiments, the electronic device may generate an inverse image by inverting a virtual residual image, and may generate, for example, a compensation image as illustrated in FIG. 14 by applying, to the generated inverse image, a compensation value calculated for each sub-pixel. Such a compensation image is continuously displayed on a display panel, so as to make it possible to overcome a residual image phenomenon occurring while an image (e.g., the images of FIG. 6) is displayed on the display panel.

Figure 15:
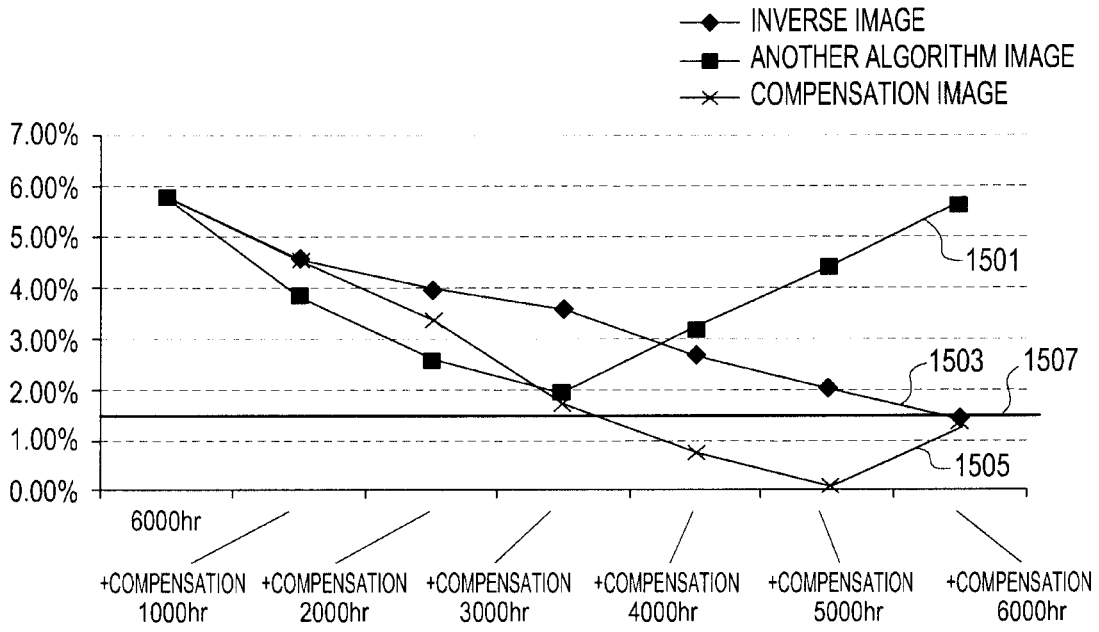
FIG. 15 is a view illustrating an experimental graph showing an effect of overcoming a residual image in an electronic device according to various embodiments of the present disclosure.
Figure 16:
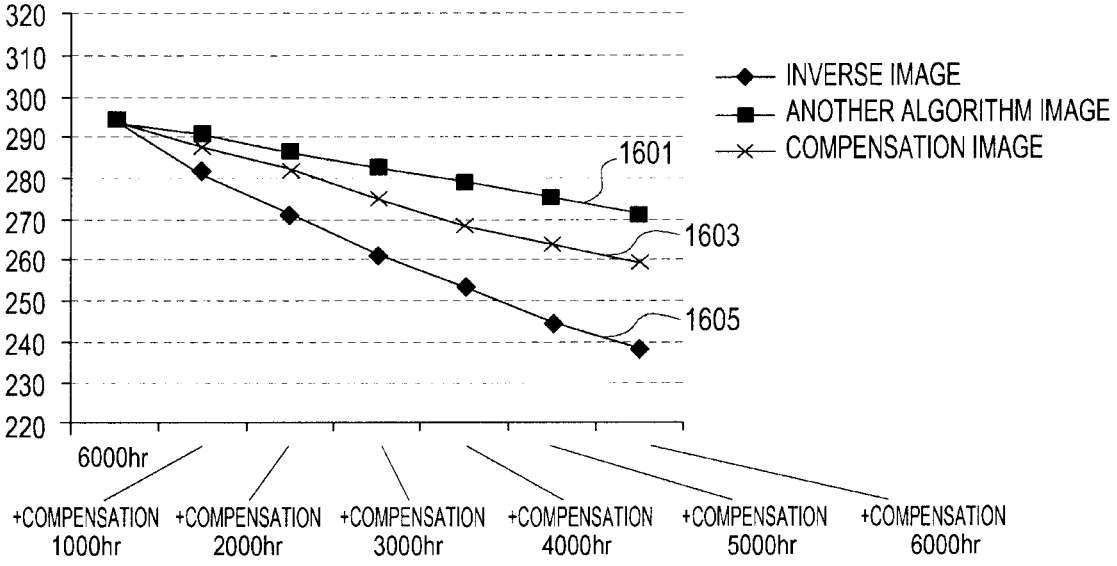
FIG. 16 is a view illustrating an experimental graph showing an effect of overcoming a residual image in an electronic device according to various embodiments of the present disclosure.

FIGS. 15 and 16 are views each illustrating an experimental graph showing an effect of overcoming a residual image in an electronic device according to various embodiments of the present disclosure.

The experimental graph illustrated in FIG. 15 shows a compensation level, and it can be noted from FIG. 15 that a generated inverse image 1503 and a generated compensation image 1505 show a better result of overcoming a residual image than that of an image 1501 according to another algorithm. When a residual image has a residual-image luminance difference less than or equal to 2%, it is difficult to see and recognize the residual image with the naked eye.

In the graph of FIG. 15, it can be noted that the image 1501 according to another algorithm most quickly reaches a level 1507 but shows the occurrence of reverse compensation before compensation for all of the pixels is performed, and shows the lowest luminance degradation but does not allow compensation for luminance degradation.

In the graph of FIG. 15, it can be noted that the inverse image 1503 generated according to various embodiments of the present disclosure shows gradual compensation for a residual image.

In the graph of FIG. 15, it can be noted that compensation for all of the pixels is completed when the compensation image 1505 generated according to various embodiments of the present disclosure reaches, for example, 3000 hours, and the compensation level becomes better with the additional passage of time. This result signifies disproof indicating that reverse compensation is not performed, and indicates the occurrence of reverse compensation in which the slope is reverse even after a residual-image luminance difference becomes 0%.

The experimental graph illustrated in FIG. 16 may represent a graph for showing a luminance degradation level. In the experimental graph of FIG. 16, it can be noted that the luminance of an inverse image is reduced, for example, by 20% (e.g., reduction to 240 from 290) for 6000 hours, and then shows completion of compensation, and the luminance of a compensation image is reduced, for example, by only 5% for 3000 hours, and then shows completion of compensation.

An operation control method of an electronic device, according to one of various embodiments of the present disclosure, may include idnetifying sub-pixel-specific cumulative image data of an OLED display panel while a plurality of frames are displayed on the OLED display panel, when an event for compensating for a residual image occurs, generating a compensation image for compensating for a residual image occurring on the OLED display panel on the basis of the sub-pixel-specific cumulative image data, and displaying the generated compensation image on the OLED display panel.

According to various embodiments of the present disclosure, generating the compensation image may include generating a virtual residual image on the basis of the sub-pixel-specific cumulative image data, and generating the compensation image by inverting the generated virtual residual image.

According to various embodiments of the present disclosure, generating the compensation image may further include in the virtual residual image, configuring, to be white, a pixel including a sub-pixel having the largest cumulative value of the sub-pixel-specific cumulative image data and configuring, to be black, a pixel including a sub-pixel having the smallest cumulative value of the sub-pixel-specific cumulative image data.

According to various embodiments of the present disclosure, generating the compensation image may include calculating a sub-pixel-specific compensation value; generating an inverted image by inverting the virtual residual image on the basis of the calculated sub-pixel-specific compensation value, and generating the compensation image by applying the calculated sub-pixel-specific compensation value to the inverted image.

According to various embodiments of the present disclosure, generating the compensation image may include identifying luminance degradation on the basis of the sub-pixel-specific cumulative image data accumulated for each sub-pixel on the OLED display panel, generating a virtual residual image on the basis of a level of the idnetified luminance degradation, and generating the compensation image by using the virtual residual image. wherein the sub-pixel-specific cumulative image data is converted into a light emission amount per hour of a pixel, and the level of the luminance degradation is identified for each sub-pixel by using the converted light emission amount and a configured look-up table.

According to various embodiments of the present disclosure, generating the compensation image may include generating the compensation image at a time set by a user, when a request for compensating for a residual image is received as the event through an external interface from the user.

According to various embodiments of the present disclosure, generating the compensation image may include when a level of luminance degradation becomes lower than or equal to a set value in a particular pixel area, generating the event for the compensation for the residual image, and notifying a user that it is necessary to compensate for a residual image. According to various embodiments of the present disclosure, the operation control method may further include initializing the sub-pixel-specific cumulative data when the event occurs and the compensation image is displayed.

Figure 17:
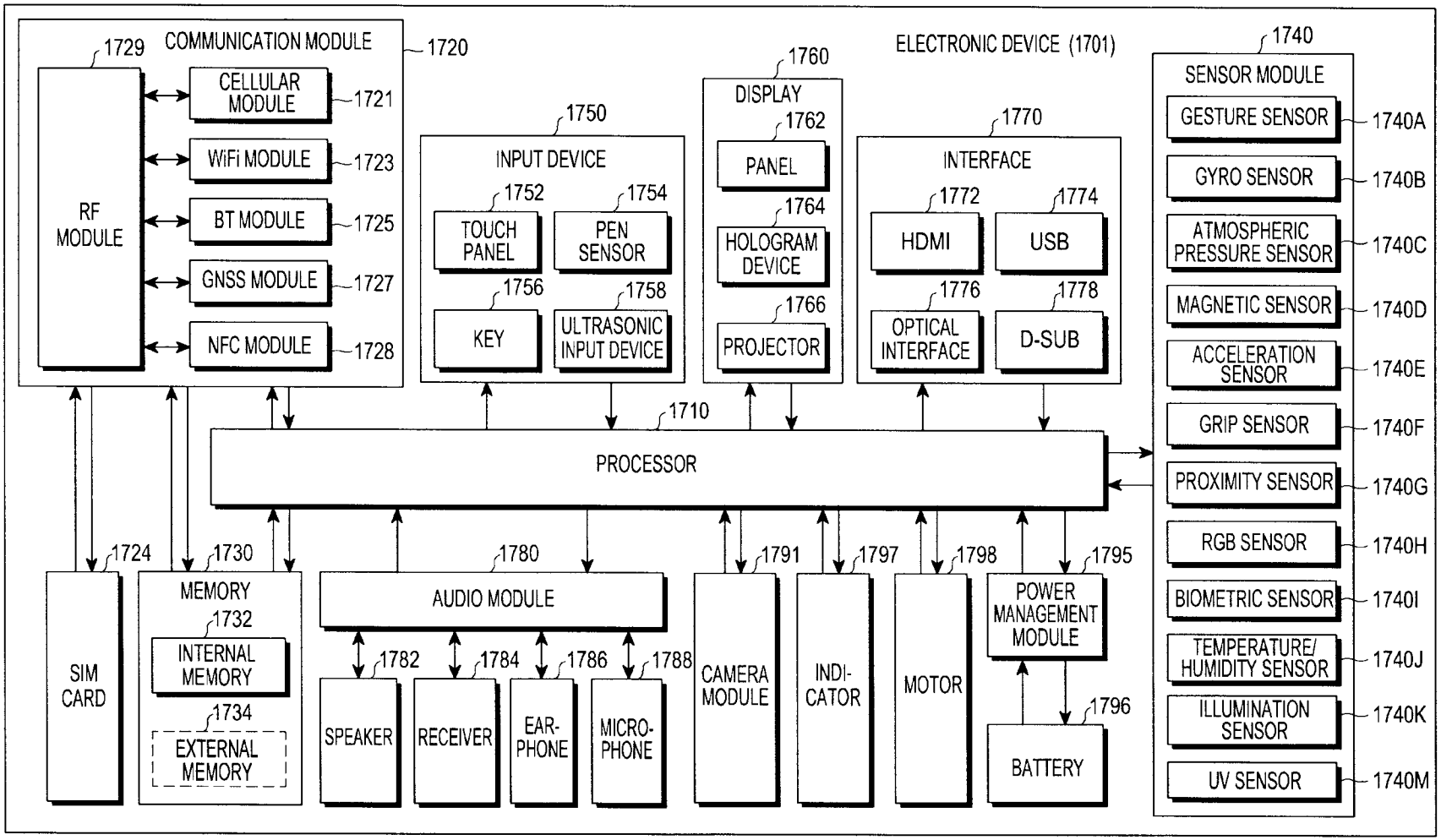
FIG. 17 is a block diagram of an electronic device according to various embodiments.

FIG. 17 is a block diagram illustrating an electronic device according to various embodiments.

The electronic device 1701 may include, for example, the entirety, or a part, of the electronic device 101 illustrated in FIG. 1. The electronic device 1701 may include at least one processor (e.g., an AP) 1710, a communication module 1720, a subscriber identification module 1724, a memory 1730, a sensor module 1740, an input device 1750, a display 1760, an interface 1770, an audio module 1780, a camera module 1791, a power management module 1795, a battery 1796, an indicator 1797, and a motor 1798. The processor 1710, for example, may be configured to drive an operating system or application programs to control multiple hardware or software elements connected thereto, and perform various types of data processing and operations. The processor 1710 may be implemented by, for example, a System on Chip (SoC). According to an embodiment, the processor 1710 may further include a Graphic Processing Unit (GPU) and/or an image signal processor. The processor 1710 may include at least some (e.g., a cellular module 1721) of the elements illustrated in FIG. 12. The processor 1710 may load, into a volatile memory, commands or data received from at least one of the other elements (e.g., a non-volatile memory) to process the same, and may store resulting data in the non-volatile memory.

The communication module 1720 may have a configuration identical or similar to that of the communication interface 170. The communication module 1720 may include, for example, the cellular module 1721, a Wi-Fi module 1723, a Bluetooth module 1725, a GNSS module 1727, an NFC module 1728, and an RF module 1729. The cellular module 1721 may provide, for example, a voice call, a video call, a text message service, an Internet service, and the like through a communication network. According to an embodiment, the cellular module 1721 may identify and authenticate the electronic device 1701 within a communication network by using the subscriber identification module (e.g., a SIM card) 1724. According to an embodiment, the cellular module 1721 may perform at least some of the functions that the processor 1710 may provide. According to an embodiment, the cellular module 1721 may include a Communication Processor (CP). According to some embodiments, at least some (e.g., two or more) of the cellular module 1721, the Wi-Fi module 1723, the Bluetooth module 1725, the GNSS module 1727, and the NFC module 1728 may be included in one Integrated Chip (IC) or IC package. The RF module 1729 may transmit or receive, for example, a communication signal (e.g., an RF signal). The RF module 1729 may include, for example, a transceiver, a Power Amplifier Module (PAM), a frequency filter, a Low Noise Amplifier (LNA), an antenna, and the like. According to another embodiment, at least one of the cellular module 1721, the Wi-Fi module 1723, the Bluetooth module 1725, the GNSS module 1727, and the NFC module 1728 may transmit or receive an RF signal through a separate RF module. The subscriber identification module 1724 may include, for example, a card or an embedded SIM including a subscriber identification module, and may include unique identify information (e.g., an Integrated Circuit Card Identifier (ICCID)) or subscriber information (e.g., an International Mobile Subscriber Identity (IMSI)).

The memory 1730 (e.g., the memory 130) may include, for example, an internal memory 1732 or an external memory 1734. The internal memory 1732 may include, for example, at least one of: a volatile memory (e.g., a Dynamic Random Access Memory (DRAM), a Static RAM (SRAM), or a Synchronous DRAM (SDRAM)), and a nonvolatile memory (e.g., a One-Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a flash memory, a hard drive, or a Solid-State Drive (SSD)). The external memory 1734 may include a flash drive, for example, Compact Flash (CF), Secure Digital (SD), Micro Secure Digital (Micro-SD), Mini Secure Digital (Mini-SD), extreme Digital (xD), a Multi-Media Card (MMC), or a memory stick. The external memory 1734 may be functionally or physically connected to the electronic device 1701 through various interfaces.

The sensor module 1740 may, for example, measure a physical quantity or detect the operating state of the electronic device 1701 and may convert the measured or detected information into an electrical signal. The sensor module 1740 may include, for example, at least one of a gesture sensor 1740A, a gyro sensor 1740B, an atmospheric pressure sensor 1740C, a magnetic sensor 1740D, an acceleration sensor 1740E, a grip sensor 1740F, a proximity sensor 1740G a color sensor 1740H (e.g., a Red, Green, and Blue (RGB) sensor), a biometric sensor 1740I, a temperature/humidity sensor 1740J, an illuminance sensor 1740K, and an Ultraviolet (UV) sensor 1740M. Additionally or alternatively, the sensor module 1740 may include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1740 may further include a control circuit configured to control at least one sensor included therein. In some embodiments, the electronic device 1701 may further include a processor configured to control the sensor module 1740 as a part of the processor 1710 or separately from the processor 1710, so as to control the sensor module 1740 while the processor 1710 is in a sleep state.

The input device 1750 may include, for example, a touch panel 1752, a (digital) pen sensor 1754, a key 1756, or an ultrasonic input unit 1758. The touch panel 1752 may use, for example, at least one of capacitive, resistive, infrared, and ultrasonic methods. Also, the touch panel 1752 may further include a control circuit. The touch panel 1752 may further include a tactile layer to provide, to a user, a tactile reaction. The (digital) pen sensor 1754 may include, for example, a recognition sheet that is a part of the touch panel or is separate from the touch panel. The key 1756 may include, for example, a physical button, an optical key, or a keypad. The ultrasonic input device 1758 may detect an ultrasonic wave generated by an input tool through a microphone (e.g., a microphone 1788), and may check data corresponding to the detected ultrasonic wave.

The display 1760 (e.g., the display 170) may include a panel 1762, a hologram device 1764, a projector 1766, and/or a control circuit configured to control them. The panel 1762 may be implemented to be, for example, flexible, transparent, or wearable. The panel 1762, together with the touch panel 1752, may be implemented as at least one module. According to an embodiment, the panel 1762 may include a pressure sensor (or force sensor) capable of measuring the strength of a pressure by the user's touch. The pressure sensor may be implemented in a single body with the touch panel 1752, or may be implemented by one or more sensors separate from the touch panel 1752. The hologram device 1764 may show a three-dimensional image in the air by using an interference of light. The projector 1766 may display an image by projecting light onto a screen. The screen may be, for example, located inside or outside of the electronic device 1701. The interface 1770 may include, for example, a High-Definition Multimedia Interface (HDMI) 1772, a Universal Serial Bus (USB) 1774, an optical interface 1776, or a D-subminiature (D-sub) 1778. The interface 1770 may be included, for example, in the communication interface 170 illustrated in FIG. 1. Additionally or alternatively, the interface 1770 may include, for example, a Mobile High-definition Link (MHL) interface, a Secure Digital (SD) card/Multi-Media Card (MMC) interface, or an Infrared Data association (IrDA) standard interface.

The audio module 1780 may convert, for example, a sound signal into an electrical signal, and vice versa. At least some elements of the audio module 1780 may be included, for example, in the input/output interface 145 illustrated in FIG. 1. The audio module 1780 may process sound information that is input or output through, for example, a speaker 1782, a receiver 1784, an earphone 1786, the microphone 1788, or the like. The camera module 1791 is, for example, a device capable of capturing a still image and a moving image. According to an embodiment, the camera module 1791 may include one or more image sensors (e.g., a front sensor or a rear sensor), a lens, an Image Signal Processor (ISP), or a flash (e.g., an LED or a xenon lamp). The power management module 1795 may manage, for example, power of the electronic device 1701. According to an embodiment, the power management module 1795 may include a Power Management Integrated Circuit (PMIC), a charger Integrated Circuit (IC), or a battery or fuel gauge. The PMIC may have a wired and/or wireless charging method. Examples of the wireless charging method may include a magnetic resonance method, a magnetic induction method, an electromagnetic wave method, and the like, and an additional circuit, such as a coil loop, a resonance circuit, or a rectifier, may be further included for wireless charging. The battery gauge may measure, for example, a residual quantity of the battery 1796, and a voltage, current, or temperature thereof while the battery is charged. The battery 1796 may include, for example, a rechargeable battery and/or a solar battery.

The indicator 1797 may indicate a particular state (e.g., a booting state, a message state, or a charging state) of the electronic device 1701 or a part (e.g., the processor 1710) thereof. The motor 1798 may convert an electrical signal into a mechanical vibration and may generate a vibration, a haptic effect, and the like. The electronic device 1701 may include a mobile TV supporting device (e.g., a GPU) capable of processing media data according to, for example, Digital Multimedia Broadcasting (DMB), Digital Video Broadcasting (DVB), or mediaFlo™ standards. Each of the above-described elements of hardware according to the present disclosure may include one or more components, and the names of the corresponding elements may vary with the type of electronic device. In various embodiments, some elements may be omitted from the electronic device (e.g., the electronic device 1701) or additional elements may be further included therein, or some of the elements may be combined into a single entity that may perform functions identical to those of the relevant elements before combined.

Figure 18:
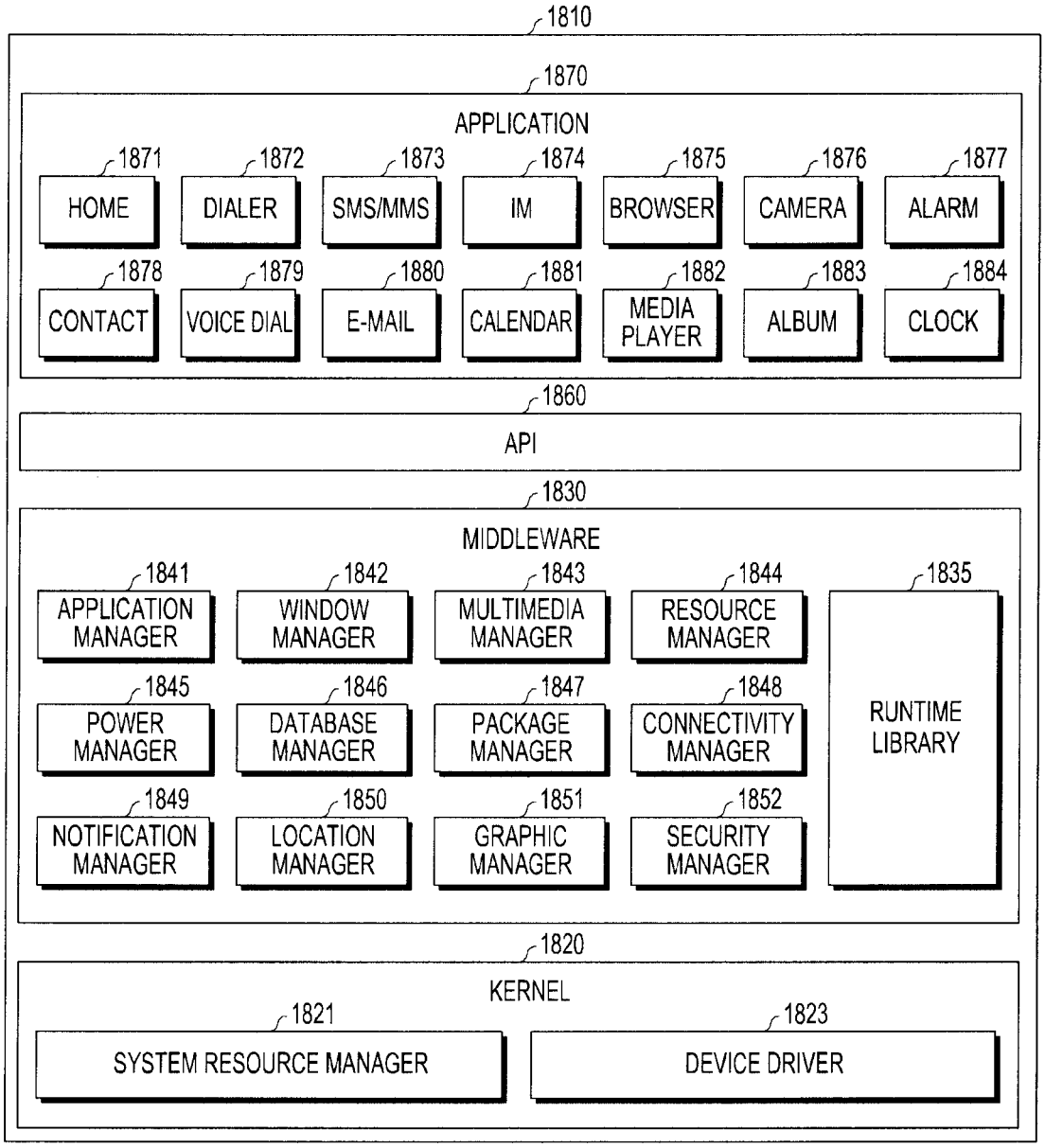
FIG. 18 is a block diagram of a program module according to various embodiments.

FIG. 18 is a block diagram illustrating a program module according to various embodiments.

According to an embodiment, the program module 1810 (e.g., the program 140) may include an operating system that controls resources related to an electronic device (e.g., the electronic device 101) and/or various applications (e.g., the application programs 147) executed on the operating system. The operating system may be, for example, Android™, iOS™, Windows™, Symbiian™, Tizen™, or Bada™. Referring to FIG. 13, the program module 1810 may include a kernel 1820 (e.g., the kernel 141), middleware 1830 (e.g., the middleware 143), an API 1860 (e.g., the API 145), and/or an application 1870 (e.g., the application program 147). At least a part of the program module 1810 may be preloaded on the electronic device, or may be downloaded from an external electronic device (e.g., the electronic device 102 or 104 or the server 106).

The kernel 1820 may include, for example, a system resource manager 1821 and/or a device driver 1823. The system resource manager 1821 may control, allocate, or retrieve system resources. According to an embodiment, the system resource manager 1821 may include a process manager, a memory manager, or a file system manager. The device driver 1823 may include, for example, a display driver, a camera driver, a Bluetooth driver, a shared-memory driver, a USB driver, a keypad driver, a Wi-Fi driver, an audio driver, or an Inter-Process Communication (IPC) driver. The middleware 1830 may provide, for example, a function which the application 1870 needs in common, or may provide various functions to the application 1870 through the API 1860 so that the application 1870 can use limited system resources in the electronic device. According to an embodiment, the middleware 1830 may include, for example, at least one of a runtime library 1835, an application manager 1841, a window manager 1842, a multimedia manager 1843, a resource manager 1844, a power manager 1845, a database manager 1846, a package manager 1847, a connectivity manager 1848, a notification manager 1849, a location manager 1850, a graphic manager 1851, and a security manager 1852.

The runtime library 1835 may include, for example, a library module used by a compiler to add a new function through a programming language while the applications 1870 are executed. The runtime library 1835 may perform input/output management, memory management, or arithmetic function processing. The application manager 1841 may manage, for example, the life cycle of the application 1870. The window manager 1842 may manage GUI resources used on a screen. The multimedia manager 1843 may detect a format necessary to reproduce media files, and may encode or decode media files by using a coder/decoder (codec) appropriate for the relevant format. The resource manager 1844 may manage a source code or memory space of the application 1870. The power manager 1845 may manage, for example, the capacity of a battery or power, and may provide power information necessary for an operation of an electronic device. According to an embodiment, the power manager 1845 may interwork with a Basic Input/Output System (BIOS). The database manager 1846 may, for example, generate, search, or change a database to be used in the applications 1870. The package manager 1847 may manage installation or update of an application distributed in the form of a package file.

The connectivity manager 1848 may manage, for example, wireless connectivity. The notification manager 1849 may provide a user with an event, for example, arrival message, promise, or proximity notification. The location manager 1850 may manage, for example, location information of the electronic device. The graphic manager 1851 may manage, for example, a graphic effect to be provided to a user and a user interface related thereto. The security manager 1852 may provide, for example, system security or user authentication. According to an embodiment, the middleware 1830 may include a telephony manager for managing a voice or video call function of the electronic device or a middleware module capable of forming a combination of the functions of the above-described elements. According to an embodiment, the middleware 1830 may provide a module specialized according to the type of operating system. The middleware 1830 may dynamically remove some of the existing elements, or may add new elements thereto. The API 1860 may be a set of, for example, API programming functions and may have different configurations depending on operating systems. For example, in the case of Android or iOS, one API set may be provided for each platform, and in the case of Tizen, two or more API sets may be provided for each platform.

The application 1870 may include an application that provides, for example, a home 1871, a dialer 1872, an SMS/MMS 1873, an Instant Message (IM) 1874, a browser 1875, a camera 1876, an alarm 1877, a contact 1878, a voice dial 1879, an e-mail 1880, a calendar 1881, a media player 1882, an album 1883, and a watch 1884, health care (e.g., measuring an exercise quantity or blood sugar), or environmental information (e.g., atmospheric pressure, humidity, or temperature information). According to an embodiment, the application 1870 may include an information exchange application capable of supporting information exchange between the electronic device and an external electronic device. Examples of the information exchange application may include a notification relay application for delivering particular information to the external electronic device, or a device management application for managing the external electronic device. For example, the notification relay application may deliver notification information generated by another application of the electronic device to the external electronic device, or may receive notification information from the external electronic device and provide the received notification information to the user. For example, the device management application may install, delete, or update a function (e.g., turning-on/turning-off the external electronic device itself (or some elements) or adjusting the brightness (or resolution) of the display) of the external electronic device communicating with the electronic device or an application operating on the external electronic device. According to an embodiment, the application 1870 may include an application (e.g., a health-care application of a mobile medical device) designated according to an attribute of the external electronic device. According to an embodiment, the application 1870 may include an application received from the external electronic device. At least a part of the program module 1810 may be implemented (e.g., executed) in software, firmware, hardware (e.g., the processor 210), or as a combination of at least two or more thereof, and may include a module, program, routine, instruction set, or process for performing one or more functions.

The term "module" as used herein may include a unit consisting of hardware, software, or firmware, and may, for example, be used interchangeably with the term "logic", "logical block", "component", "circuit", or the like. The "module" may be an integrated component, or a minimum unit for performing one or more functions or a part thereof. The "module" may be mechanically or electronically implemented and may include, for example, an Application-Specific Integrated Circuit (ASIC) chip, a Field-Programmable Gate Arrays (FPGA), or a programmable-logic device, which has been known or are to be developed in the future, for performing certain operations. At least some of devices (e.g., modules or functions thereof) or methods (e.g., operations) according to various embodiments may be implemented by an instruction which is stored a computer-readable storage medium (e.g., the memory 140) in the form of a program module. When the instruction executed by a processor (e.g., the processor 130), the processor may perform a function corresponding to the instruction. The computer-readable storage medium may include a hard disk, a floppy disk, a magnetic medium (e.g., a magnetic tape), an Optical Media (e.g., CD-ROM, DVD), a Magneto-Optical Media (e.g., a floptical disk), an inner memory, etc. The instruction may include a code made by a complier or a code that can be executed by an interpreter. The programming module according to the present disclosure may include one or more of the aforementioned components or may further include other additional components, or some of the aforementioned components may be omitted. The operations performed by modules, programming modules, or other elements according to various embodiments may be performed in a sequential, parallel, repetitive, or heuristic manner, and some of the operations may be performed in different orders or omitted, or other operations may be added.

Various embodiments of the present disclosure may provide a computer-readable recording medium configured to record a program executed on a computer, wherein, when executed by a processor, the program causes the processor to perform identifying sub-pixel-specific cumulative image data of an OLED display panel while a plurality of frames are displayed on the OLED display panel, when an event for compensation for a residual image occurs, generating a compensation image for compensating for a residual image occurring on the OLED display panel on the basis of the sub-pixel-specific cumulative image data, and displaying the generated compensation image on the OLED display panel.

Also, embodiments disclosed herein are provided to describe technical details of the present disclosure and help understanding of the present disclosure, and do not limit the scope of the present disclosure. Therefore, it should be construed that the scope of the present disclosure covers all modifications and changes or various other embodiments based on the technical idea of the present disclosure.

The invention claimed is:

1. An electronic device comprising:

an Organic Light-Emitting Diode (OLED) display panel comprising a plurality of sub-pixels;

a memory; and a processor, wherein the processor is configured to:

identify sub-pixel-specific cumulative image data of the OLED display panel while a plurality of frames are displayed on the OLED display panel;

obtain an inverse image by inverting a virtual residual image;

obtain a compensation image based on the inverse image; and display the compensation image on the OLED display panel to compensate for a residual image occurring on the OLED display panel, wherein the processor is further configured to:

convert the sub-pixel-specific cumulative image data into a light emission amount per hour of a sub-pixel;

identify a sub-pixel-specific luminance degradation level by using the converted light emission amount and a configured look-up table (LUT); and generate the virtual residual image based on the sub-pixel-specific luminance degradation level.

2. The electronic device of claim 1, wherein the processor is configured to:

configure, to be white, a pixel comprising a sub-pixel having a largest pixel value in the compensation image; and configure, to be black, a pixel comprising a sub-pixel having a smallest pixel value in the compensation image.

3. The electronic device of claim 1, wherein the processor is configured to:

calculate a compensation value for each sub-pixel; and generate the compensation image by compensating for an inverse image, obtained by inverting the virtual residual image, based on the calculated compensation value.

4. The electronic device of claim 1, wherein the processor is configured to:

identify luminance degradation based on cumulative data accumulated for each pixel on the OLED display panel; and generate the virtual residual image based on a luminance degradation level.

5. The electronic device of claim 1, wherein the processor is configured to generate and display the compensation image at a time set by a user, when a request for compensation for a residual image is received as an event through an external interface from the user.

6. The electronic device of claim 1, wherein the processor is configured to initialize the sub-pixel-specific cumulative image data when an event occurs and the compensation image is displayed.

7. The electronic device of claim 1, wherein the processor is configured to:

when the luminance degradation level becomes lower than or equal to a set value in a particular pixel area, generate a residual-image compensation event; and notify a user that it is necessary to compensate for a residual image.

8. The electronic device of claim 1, wherein the processor is configured to, when a fixed moving image is repeatedly displayed on the OLED display panel, generate the compensation image by inverting the virtual residual image generated based on images of the fixed moving image without accumulating image data until a time point when an event occurs.

9. An operation control method of an electronic device, the operation control method comprising:

identifying sub-pixel-specific cumulative image data of an Organic Light-Emitting Diode (OLED) display panel while a plurality of frames are displayed on the OLED display panel;

converting the sub-pixel-specific cumulative image data into a light emission amount per hour of a sub-pixel;

identifying a sub-pixel-specific luminance degradation level by using the converted light emission amount and a configured look-up table (LUT);

generating a virtual residual image based on the sub-pixel-specific luminance degradation level:

obtaining an inverse image by inverting the virtual residual image;

obtaining a compensation image based on the inverse image; and displaying the compensation image on the OLED display panel to compensate for a residual image occurring on the OLED display panel.

10. The operation control method of claim 9, wherein the obtaining of the compensation image comprises:

configuring, to be white, a pixel comprising a sub-pixel having a largest pixel value in the compensation image; and configuring, to be black, a pixel comprising a sub-pixel having a smallest pixel value in the compensation image.

11. The operation control method of claim 9, wherein the obtaining of the compensation image comprises:

when a level of luminance degradation becomes lower than or equal to a set value in a particular pixel area, generating an event for the compensation for the residual image; and notifying a user that it is necessary to compensate for a residual image.

12. The operation control method of claim 9, wherein the obtaining of the compensation image comprises generating the compensation image at a time set by a user, when a request for compensation for a residual image is received as an event through an external interface from the user.

* * * * *